US005750463A

United States Patent [19]

Dombrowski, Jr. et al.

[11] Patent Number: 5,750,463

[45] Date of Patent: May 12, 1998

[54] THERMOGRAPHIC RECORDING FILMS

[75] Inventors: Edward J. Dombrowski, Jr., Bellingham; Robert L. Jones, Dracut; John C. Warner, Norwood, all of Mass.; Jiyue Yang, Warwick, N.Y.

[73] Assignee: Polaroid Corporation, Cambridge, Mass.

[21] Appl. No.: 837,701

[22] Filed: Apr. 22, 1997

[51] Int. Cl.[6] ..... B41M 5/32

[52] U.S. Cl. ..... 503/204; 503/202; 503/209; 503/210; 503/220; 503/224

[58] Field of Search ..... 427/150–152; 503/202, 204, 209, 210, 220, 224

[56] References Cited

U.S. PATENT DOCUMENTS 4,904,572 2/1990 Dombrowski et al. ..... 430/332

*Primary Examiner*—Bruce H. Hess
*Attorney, Agent, or Firm*—Jennifer A. Kispert

[57] ABSTRACT

There is described a novel thermographic recording film, and more specifically, a novel image-forming system incorporated therein which employs both thiolactone and silver reduction chemistries.

Thermographic recording films comprising the novel image-forming system of the present invention exhibit excellent thermal sensitivity and visual color saturation, enhanced image density, and desirable visual minimum optical densities.

20 Claims, No Drawings

THERMOGRAPHIC RECORDING FILMS

The present invention relates to thermographic recording films, and more specifically, it relates to a novel image-forming system incorporated therein employing both thiolactone and silver reduction chemistries. Thermographic recording films comprising the novel image-forming system exhibit excellent thermal sensitivity and visual color saturation, and enhanced image density.

BACKGROUND OF THE INVENTION

Image-forming systems incorporated in thermographic recording films utilizing, for example, thiolactone or silver reduction chemistries, are well known in the art.

Thermographic recording films utilizing thiolactone chemistry are described, for example, in European Patent No. 250,558 and U.S. Pat. Nos. 4,904,572; 4,970,309; 5,028,725; 5,196,297; 5,198,406; 5,220,036; 5,278,127; 5,411,929; 5,480,855; and 5,489,566. The thiolactone imaging layer of the image-forming system incorporated in the thermographic recording film comprises colorless dye precursors which are color-forming di- and triarylmethane compounds possessing certain sulfur-containing ring closing moieties, e.g., a thiolactone, a dithiolactone or a thioether ring closing moiety.

These colorless dye precursors undergo coloration by contacting with a Lewis acid material such as a metal ion of a heavy metal, generally silver, capable of opening the sulfur-containing ring moiety to form a colored metal-complex. More specifically, upon imagewise heating, the lactone or lactam ring closed on the methane carbon atom is opened and colored by an ionization or hydrogen bonding reaction when contacted with the Lewis acid material, e.g., silver behenate. The ability of such dye precursors to form a colored dye almost instantaneously when contacted with $Ag^+$ renders them eminently suitable for use as color formers in thermal imaging systems employing such Lewis acid materials.

As described in U.S. Pat. Nos. 4,904,572 and 5,196,297, in addition to a di- or triarylmethane thiolactone dye precursor and a Lewis acid material such as a light insensitive organic silver salt, the thiolactone dye release imaging layer described above further comprises a binder and an acidic organic material, preferably, 3,5-dihydroxybenzoic acid, which upon imagewise heating of the recording film to the processing temperature, provide an improved reaction medium for facilitating contact and reaction of the thiolactone dye precursor and the $Ag^+$, liberated from the melted light insensitive organic silver salt, to produce the dye image.

Thermographic recording films utilizing silver reduction chemistry are described, for example, in U.S. Pat. Nos. 5,275,932; 5,416,058; and 5,424,182. Silver reduction chemistry uses a light insensitive thermally-reducible source of silver, generally, a silver salt of a long chain aliphatic carboxylic acid, such as silver behenate. Upon the imagewise application of heat, the light insensitive thermally-reducible source of silver is reduced by a reducing agent for silver ion, such as methyl gallate, whereby an image is formed.

In addition to the image-forming systems discussed above which utilize a single type of imaging chemistry, image-forming systems utilizing a combination of imaging chemistries are also known to the thermographic art, for example, as described in U.S. Pat. No. 5,559,075.

For example, U.S. Pat. No. 4,426,441 describes a thermographic material for producing a dye image which includes, in reactive association, a dye-forming coupler and an oxidation-reduction image-forming combination which includes an organic silver salt oxidizing agent such as silver behenate and an organic reducing agent, i.e., a ureidoaniline which is capable in its oxidized form of reacting with the dye-forming coupler to form a dye.

Likewise, U.S. Pat. No. 4,374,921 describes a photothermographic layer which includes a silver source material, e.g., silver behenate, a photosensitive silver halide in catalytic proximity to the silver source material and a reducing agent for silver ion, i.e., an indoaniline leuco dye in the presence of an aromatic carboxylic acid and a p-alkylphenyl sulfonic acid.

Similarly, International Application No. PCT/US92/04355 published Mar. 4, 1993 as International Publication No. WO 93/04398 describes a photothermographic material containing a negative image-forming system which includes a light insensitive silver source material, e.g., silver behenate, a light sensitive silver halide and a fluoran dye.

As would be appreciated by those of skill in the thermographic art, the thermographic and photothermographic materials described above which include image-forming systems utilizing silver reduction chemistry in combination with oxidation-reduction type reactive associations, e.g., a leuco dye which is oxidized to its colored form, must withstand any reactivity of the dyes which might render them unstable in oxidation systems. For example, as discussed in U.S. Pat. No. 4,374,921, indoaniline dyes, but for a limited class, exhibit reactivity in photothermographic systems which renders them unstable in oxidation systems.

Therefore, the performance of image-forming systems referred to above which utilize silver reduction chemistry in combination with oxidation-reduction type reactive associations is not completely satisfactory in some photographic systems, e.g., conditions where the reactivity of the dyes renders them unstable in oxidation systems. Thus, it would be advantageous to develop thermographic recording films comprising novel image-forming systems to attain the performance criteria required of particular photographic systems; hence, investigations continue to be pursued to provide advantages over those already known to the art.

As stated earlier, and in contrast to the above-described oxidation-reduction type reactive associations used in conjunction with silver reduction chemistry, thiolactone chemistry employs a colorless dye precursor and a Lewis acid material wherein the colorless dye precursor becomes colored by an ionization or hydrogen bonding reaction when contacted with the Lewis acid material.

It has now been discovered that thermographic recording films comprising an image-forming system which utilizes thiolactone and silver reduction chemistries exhibit excellent thermal sensitivity and visual color saturation, and enhanced image density.

Accordingly, the present invention relates to thermographic recording films, and more specifically, it relates to the use of a novel image-forming system incorporated therein which utilizes thiolactone and silver reduction chemistries to form the image.

SUMMARY OF THE INVENTION

These and other objects and advantages are accomplished in accordance with the invention by providing a thermographic recording film which comprises a support carrying an image-forming system comprising a Lewis acid, a di- or triarylmethane thiolactone dye precursor, an acidic material, a binder, a light insensitive organic silver salt and a reducing agent for the light insensitive organic silver salt.

Preferably, the image-forming system comprises a first layer comprising the Lewis acid, the di- or triarylmethane thiolactone dye precursor, the acidic material and a binder, and a second layer comprising the light insensitive organic silver salt, the reducing agent for the light insensitive organic silver salt and a binder. Alternatively, all of the components of the image-forming system may be coated together as a single imaging layer.

In preferred embodiments, the Lewis acid and the light insensitive organic silver salt are silver behenate, the acidic organic material is 3,5-dihydroxybenzoic acid, the binder is polyvinylbutyral and the reducing agent is methyl gallate. It is preferred to further include a surfactant, preferably, a fluorocarbon surfactant, a toning agent, preferably, phthalazinone, and a thermal stabilizer, preferably, bis[1,2,2,6,6-pentamethyl-4-piperidynl]sebacate.

In embodiments wherein the image-forming system comprises a first layer comprising the Lewis acid, the di- or triarylmethane thiolactone dye precursor, the acidic material and a binder, and a second layer comprising the light insensitive organic silver salt, the reducing agent for the light insensitive organic silver salt and a binder, the first layer preferably comprises bis[1,2,2,6,6-pentamethyl-4-piperidynl]sebacate, the second layer preferably comprises a toning agent, and both layers preferably include a fluorocarbon surfactant. Further, in such embodiments, the layers may be coated on the support in any order; however, it is preferred to coat the first layer before coating the second layer.

In preferred embodiments, the thermographic recording film is brought into direct contact with the thermal head of a thermal printing head whereby an image is formed by imagewise heating of the medium. In such embodiments, it is preferred to further include a protective layer.

It has been found that thermographic recording films comprising an image-forming system which utilizes a combination of thiolactone and silver reduction chemistries exhibits a net benefit in thermal sensitivity over that shown by the two chemistries individually, excellent visual color saturation, enhanced maximum image density ($D_{max}$) in the visible and UV regions of the spectrum, and desirable visual minimum optical densities ($D_{min}$).

These and other objects and advantages which are provided in accordance with the invention will in part be obvious and in part be described hereinafter in conjunction with the detailed description of various preferred embodiments of the invention. The invention accordingly comprises the processes involving the several steps and relation and order of one or more of such steps with respect to each of the others, and the product and compositions possessing the features, properties and relation of elements which are exemplified in the following detailed disclosure, and the scope of the application of which will be indicated in the claims.

For a fuller understanding of the nature and objects of the invention, reference should be had to the following detailed description of the preferred embodiments.

DESCRIPTION OF THE PREFERRED EMBODIMENTS

The thermographic recording film according to the present invention comprises a support carrying an image-forming system which includes a Lewis acid material, a di- or triarylmethane thiolactone dye precursor, an acidic organic material, a binder, a light insensitive organic silver salt and a reducing agent for light insensitive organic silver salt.

Any suitable Lewis acid material, e.g., light insensitive organic silver salt, known in the art for use in thermographic materials may be used in the thiolactone imaging layer of the present invention, such as, for example, those described in European Patent No. 250,558 and U.S. Pat. Nos. 4,904,572; 4,970,309; 5,028,725; 5,196,297; 5,198,406; 5,220,036; 5,278,127; 5,411,929; 5,480,855; and 5,489,566. It is preferred to use organic silver salts which are the silver salts of long chain, e.g., comprising at least twelve carbon atoms, aliphatic carboxylic acids, particularly, silver behenate which may be used in admixture with other organic silver salts if so desired. Also, behenic acid may be used in combination with silver behenate.

The organic silver salts including silver behenate may be prepared in a conventional manner using any of the various procedures well known in the art, such as, for example, those described in European Patent No. 250,558 and in U.S. Pat. Nos. 3,458,544; 4,028,129 and 4,273,723; or, purchased from any of a variety of commercial suppliers. The preparation of such organic silver salts is generally carried out by processes which comprise mixing a silver salt forming organic compound dispersed or dissolved in a suitable liquid with an aqueous solution of a silver salt such as silver nitrate or a silver complex salt.

The di- or triarylmethane thiolactone dye precursors of the image-forming system of the present invention will now be described in detail. The thiolactone dye precursors may be represented by formula (I)

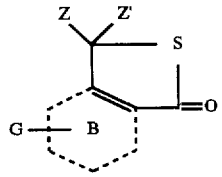

(I)

wherein:

ring B represents a substituted or unsubstituted carbocyclic aryl ring or rings, e.g., of the benzene or naphthalene series or a heterocyclic ring, e.g., pyridine or pyrimidine;

G is hydrogen or a monovalent radical; and

Z and Z' taken individually represent the moieties to complete the auxochromophoric system of a diarylmethane or a triarylmethane dye when the sulfur-containing ring is open and Z and Z' taken together represent the bridged moieties to complete the auxochromophoric system of a bridged triarylmethane dye when the sulfur-containing ring is open, i.e., when the ring sulfur atom is not bonded to the meso carbon atom.

Usually, at least one of Z and Z,' whether taken individually or together, possesses as an auxochromic substituent, a nitrogen, oxygen or sulfur atom or a group of atoms containing nitrogen, oxygen or sulfur. In a preferred embodiment, B is a benzene ring and Z and Z' taken individually or together complete the auxochromophoric system of a triarylmethane dye.

The thiolactone dye precursor compounds used in this preferred embodiment of the invention can be monomeric or polymeric compounds. Suitable polymeric compounds are those which, for example, comprise a polymeric backbone chain having dye precursor moieties attached directly thereto or through pendant linking groups.

Polymeric compounds of the invention can be provided by attachment of the dye precursor moiety to the polymeric chain via the Z and/or Z' moieties or the ring B. For example, a monomeric dye precursor compound having a reactable substituent group, such as an hydroxyl or amino group, can be conveniently reacted with a monoethylenically unsaturated, polymerizable compound having a functional and derivatizable moiety, to provide a polymerizable monomer having a pendant dye precursor moiety.

Suitable monoethylenically unsaturated compounds for this purpose include acrylyl chloride, methacrylyl chloride, methacrylic anhydride, 2-isocyanatoethyl methacrylate and 2-hydroxyethyl acrylate, which can be reacted with an appropriately substituted dye precursor compound for production of a polymerizable monomer which in turn can be polymerized in a known manner to provide a polymer having the dye precursor compound pendant from the backbone chain thereof.

The black (II), blue (III) and red (IV) thiolactone dye precursors of the image-forming system of the present invention are represented below:

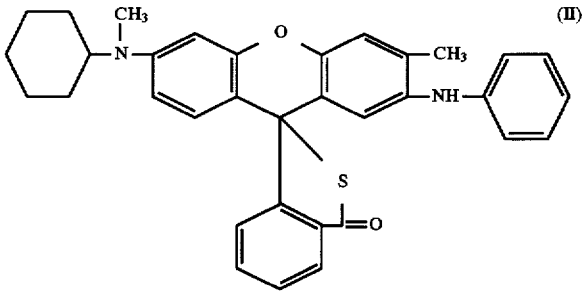

(II)

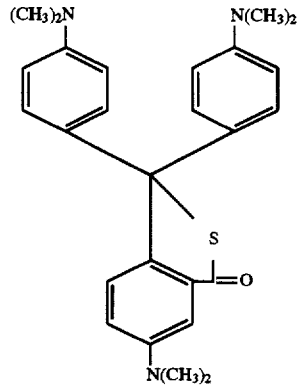

(III)

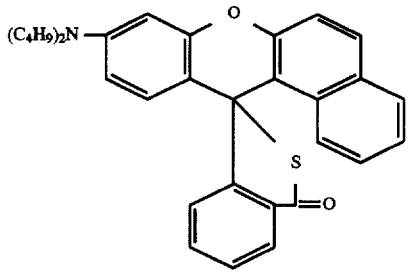

(IV)

The thiolactone dye precursors can be synthesized as is well known to the art, such as, for example, from the corresponding lactones by heating substantially equimolar amounts of the lactone and phosphorus pentasulfide or its equivalent in a suitable solvent, or, for example, as described in U.S. Pat. No. 4,904,572 or European Patent No. 250,558.

The thiolactone dye precursors depicted above are selected to give the desired color. Preferably, the image-forming system of the present invention utilizes both the black and blue dye precursors; however, use of the blue dye precursor alone would be sufficient to attain the desired results described herein. In addition, the red dye precursor may be used in combination with the black and blue dye precursors or with the blue dye precursor alone to achieve the desired results.

Any suitable acidic organic material known in the art for use in thermographic materials, such as, for example, a phenol or an organic carboxylic acid, particularly, a hydroxy-substituted aromatic carboxylic acid, may be used in the image-forming system of the present invention. In addition, any suitable combination of acidic organic materials can be employed in the present invention. It is preferred to use 3,5-dihydroxybenzoic acid as the acidic organic material.

Any suitable binder or plurality of suitable individual binder materials know in the art for use in thermographic materials may be used in the image-forming system of the present invention provided that the binder does not have any adverse effect on the other constituents of the thermographic recording film and is heat-stable at the desired processing temperatures.

Suitable binders include hydrophobic binders, such as, for example, polyvinylbutyral, cellulose acetate or ethyl cellulose; hydrophilic binders, such as, for example, gelatin, polyvinyl alcohol or hydroxyethylcellulose; including those described in European Patent No. 250,558 and U.S. Pat. No. 5,196,297. It is preferred to use polyvinylbutyral, preferably, BUTVAR-76® which is commercially available from Monsanto (St. Louis, Mo.), as the binder. Preferably, a surfactant, more preferably, a fluorocarbon surfactant, preferably, FC-431 which is commercially available from the Minnesota Mining and Manufacturing Company (St. Paul, Minn.), is present together with the binder.

Any suitable light insensitive organic silver salt, as described above, and any suitable reducing agent known in the art for use in thermographic materials may be used in the image-forming system of the present invention, such as, substituted and unsubstituted hydroquinone, hindered phenols, catechol and pyrogallol. It is preferred to use methyl gallate to reduce the silver ion.

It is preferred to further include a toning agent and a surfactant in the image-forming system of the invention. Any suitable toning agent, such as, for example, phthalazinone, phthalazine and phthalimide, preferably, phthalazinone, and/or surfactant, preferably, a fluorocarbon surfactant, preferably, FC-431 may be used in the image-forming system of the invention.

Any suitable additive known in the art for use in thermographic materials, such as, for example, a development accelerator, may be used in the image-forming system of the present invention. It is particularly preferred that the image-forming system include the thermal stabilizer disclosed and claimed in commonly-assigned, copending U.S. patent application Ser. No. 08/837,775, filed on even date herewith.

Any of the numerous suitable supports known in the art for use in thermographic materials may be used in the present invention, including transparent and reflective supports. Suitable transparent support substrates include: polyesters, polycarbonates, polystyrenes, polyolefins, cellulose esters, polysulfones and polyimides. Specific examples of suitable transparent support substrates include: polypropylene, cellulose acetate and polyethylene terephthalate. It is preferred to use polyester as the support in the thermographic recording films of the invention. Suitable reflective supports include: polyethylene clad paper (Glory Mill Papers Limited, England) and Baryta coated paper (Schoeller Technical Papers Inc., N.Y.).

In addition to the layer or layers containing the above-named components, the thermographic recording film of the present invention may contain any suitable additional layers known in the art for use in thermographic recording films, such as, subbing layers to improve adhesion to the support; interlayers or barrier layers for thermally and chemically isolating the respective organic silver salt/dye precursor layer(s) from each other; infrared absorbing layers; antihalation layers; antistatic layers; back coat layers on the support; protective layers; and, other auxiliary layers.

Furthermore, for use as magnetic tickets, e.g., commuter tickets and passes, a magnetic recording layer may be carried on the back of the support opposite the imaging layer(s). Likewise, for use as adhesive labels, an adhesive layer may be coated on the back of the support and a disposable backing sheet attached to the adhesive layer.

It is preferred to use a protective layer, such as, for example, a topcoat layer or an overcoat layer, in the thermographic recording films of the present invention, to, e.g., reduce abrasion, fingerprints, streaking, gouging, print head build-up and static electricity; improve shelf stability; enhance the transparency of the image formed, and for any other desirable effect or result which would be appreciated by one of skill in the art.

It is preferred to use a topcoat in the thermographic recording films of the present invention. Any suitable topcoat layer known in the art for use in thermographic recording materials may be used in the present invention, such as, for example, those described in U.S. Pat. Nos. 5,198,406; 5,278,127; 5,480,855; and 5,489,566 which discloses a protective layer(s) which comprises colloidal silica, a crosslinking compound and polyvinyl alcohol that prevents gouging, reduces thermal printhead build-up, enhances print performance and improves the quality of the printed image); and, those comprising chrome-hardened polyvinyl alcohol, methacrylic acid-diacrylamide copolymers and arylsulfonamideformaldehyde condensation resins containing a fluorocarbon surfactant. For example, a topcoat layer comprising a high molecular weight (MW) polyurethane latex (PU1514, commercially available from B. F. Goodrich (Akron, Ohio)) and a crosslinking compound (CX-100, commercially available from Zeneca (Wilmington, Del.)), may also be used in the thermographic recording films of the invention.

To prevent interaction of the components in the protective layer with those in the solvent soluble imaging layers beneath it and to ameliorate the environmental concerns associated with the coating from solvents, the protective layer is preferably coated out of aqueous systems. If the binders employed in the protective layer are water-insoluble, they are, preferably, either coated as latex emulsions or they are made water soluble by mixing with alkali, preferably aqueous ammonia which is lost upon drying. The protective layer may be prepared and coated either as an aqueous dispersion or as an aqueous solution over the image-forming system.

It is preferred to use an overcoat layer in the thermographic recording films of the present invention. Any suitable overcoat layer known in the art for use in thermographic recording materials may be used in the present invention. The overcoat layer may comprise any organic solvent-soluble or water-soluble polymer or resin and preferably contains a fluorochemical surfactant. In addition, the overcoat layer may contain any other material known in the art to be commonly employed in such layers, such as, UV absorbers, matting agents, higher fatty acids and/or waxes.

Suitable polymers for the overcoat layer include polyvinyl chloride, polyvinyl acetate, copolymers of vinyl chloride and vinyl acetate, polyvinylbutyral, polystyrene, polymethyl methacrylate, polyurethane, xylene resins, benzyl cellulose, ethyl cellulose, cellulose acetate butyrate, cellulose acetate, triacetate, polyvinylidene chloride, chlorinated polypropylene, polyvinylpyrrolidone, cellulose propionate, polyvinyl formal, cellulose acetate phthalate, polycarbonate and cellulose acetate propionate.

It is preferred to use a washcoat layer in the thermographic recording films of the present invention. Any suitable washcoat layer known in the art for use in thermographic recording films may be used in the present invention. For example, a washcoat having anti-slip properties may be used which comprises CYASTAT-SN (stearimidipropyl-dimethyl-β-hydroxyethylammonium nitrate), ZONYL FSN, CYA-STAT 609 (N,N'-Bis[2-hydroxyethyl]-N-[3'-dodecyl-oxy-2-hydroxypropyl]methylammonium methosulfate), Michelman Emulsion (ME 03230 silicone filtered, Silverson mixer) and a diepoxy crosslinking compound (1,4-butanediol diglycidyl ether).

As stated earlier, any suitable materials known in the art to prevent sticking of a thermographic recording film, e.g., a thermal printhead, may also be used in the present invention. For example, waxes, silica particles, styrene-containing elastomeric block polymers, e.g., styrene-butadiene-styrene, styrene-isoprene-styrene, and blends thereof with such materials as cellulose acetate, cellulose acetate butyrate and cellulose acetate propionate, may be used in the present invention. Also useful are ethylene-vinyl acetate copolymer and a terpolymer comprising chlorotrifluoroethylene, vinylidene fluoride and hexafluoropropylene.

The respective components described above for use in the thermographic recording films of the present invention may be used in any amount which is required to accomplish their intended purpose. It will be appreciated by those of skill in the art that the amount necessary in any specific instance is dependent upon a number of factors such as, for example, the specific materials utilized and the results desired. Routine scoping tests may be conducted to ascertain the concentration which is appropriate for any given thermographic recording film.

The layers of the thermographic recording film of the present invention may be coated on a suitable support, in any desirable order, by any suitable method known to those skilled in the art, e.g., coating by loop, slot, spray, air-knife, roll, dip, curtain, extrusion, hopper, silkscreen or reverse roll. If desired two or layers can be coated simultaneously. In addition, the coating compositions may contain dispersing agents, surfactants, preferably, FC-431, lubricants, preferably, polytetrafluoroethylene, plasticizers, defoaming agents, coating aids, pigments to, for example, provide a white background or a contrasting color for the dye image formed, and so forth. Preferably, the layers of the thermographic recording films of the present invention are coated using a loop coater. It is preferred to coat the imaging layer(s) from about a 10–15% methyl ethyl ketone solution onto a polyester base (4 mil) using a loop coater. In embodiments wherein the image-forming system comprises a first layer comprising the Lewis acid, the di- or triarylmethane thiolactone dye precursor, the acidic material and a binder, and a second layer comprising the light insensitive organic silver salt, the reducing agent for the light insensitive organic silver salt and a binder, it is preferred to coat the first layer before coating the second layer.

After coating, the thermographic recording films of the present invention may be dried in any suitable manner as is known in the art. The layers may be dried at ambient or elevated temperatures provided the temperature is not sufficient to effect premature color formation.

It is preferred to dry the thermographic recording films of the present invention at elevated temperature, e.g., at least about 60° C. As stated earlier, it is particularly preferred that the image-forming system include the thermal stabilizer disclosed and claimed in commonly-assigned, copending U.S. patent application Ser. No. 08/837,775, filed on even date herewith. The inclusion of this thermal stabilizer allows the thermographic recording films to be dried at higher environmental temperatures without causing substantial premature of the reactive components of the layer, as disclosed in the U.S. Patent Application.

Any suitable method of applying heat or inducing heat imagewise known in the art for use in thermographic materials may be used in the present invention, such as, for example, (1) by direct application of heat using a thermal printing head or thermal recording pen; (2) by conduction from heated image-markings of an original using conventional thermally-processable copying techniques; (3) by heat generated in response to an electric signal by including, for example, an electroconductive material or a resistive layer; or, (4) by the conversion of electromagnetic radiation, e.g., from any suitable laser beam emitting source such as a gas laser, a solid state laser, a dye laser or a semiconductor laser diode, into heat, by use of a light-to-heat converting material. It is preferred to bring the thermographic recording films of the present invention into direct contact with the thermal head of a thermal printing head whereby an image is formed by imagewise heating of the media.

The invention will now be described further in detail with respect to specific preferred embodiments by way of examples, it being understood that these are intended to be illustrative only and the invention is not limited to the materials, conditions, process parameters, etc. recited therein. All parts and percentages recited are by weight unless otherwise stated.

EXAMPLE I

Two thermographic recording films were prepared: "Test-1" was prepared according to an embodiment of the invention, i.e., the image-forming system incorporated therein comprised a first imaging layer which comprised a Lewis acid, a triarylmethane thiolactone dye precursor, an acidic organic material and a binder, and a second imaging layer which comprised a light insensitive organic silver salt, a reducing agent therefor, a toning agent and a binder; and, "Control-1," which was prepared in the same manner as Test-1, but, wherein the image-forming system comprised only the first imaging layer of Test-1, as further described below in TABLE I.

The imaging layers were coated from a 10–15% methyl ethyl ketone solution onto the polyester base (4 mil) using a loop coater and then dried at 60 ° C. The amounts of the materials used in each of the layers were calculated to give, after drying, the indicated coated coverages.

TABLE I

| MATERIAL | COVERAGE (mg/m²) Control-1 & First Imaging Layer of Test-1 | Second Imaging Layer of Test-1 |
|---|---|---|
| Silver Behenate | 1339.34 | 4018.11 |
| Polyvinylbutyral (Butvar-76, Monsanto) | 4090.27 | 5084.76 |
| Methyl Gallate | — | 1646.68 |
| Phthalazinone | — | 209.94 |
| Leuco Thiolactone Dye (black:blue, 50:50) (formulae (II) and (III) herein) | 430.56 | — |
| 3,5-dihydroxybenzoic acid | 430.55 | — |

For the determination of visual minimum optical density ($D_{min}$), both recording films were imaged, one day after the films were prepared, at room temperature.

For the determination of visual maximum optical density ($D_{max}$), both recording films were imaged by means of a hot plate at 120° C. for 90 seconds. $D_{min}$ and $D_{max}$ were determined using an Xrite recorder, and are reported in TABLE II.

TABLE II

| | $D_{max}$ | $D_{min}$ |
|---|---|---|
| Control-1 | 1.51 | 0.026 |
| Test-1 | 2.83 | 0.040 |

As will be appreciated from the $D_{max}$ values reported in TABLE II, a thermographic recording film prepared according to the invention, i.e., Test-1, results in an image of substantially higher density than a thermographic recording film comprising an image-forming system utilizing thiolactone dye chemistry but not silver reduction chemistry, i.e., Control-1.

EXAMPLE II

Three thermographic recording films were prepared: "Test-2" was prepared as for "Test-1" of Example I, "Control-2" was prepared as for "Control-1" of Example I, and "Control-3" was prepared in the same manner as "Test-1," of Example I but the image-forming system comprised only the second imaging layer of Test-1, as further described below in TABLE III.

The imaging layers were coated from a 10–15% methyl ethyl ketone solution. Each layer was coated onto the polyester base (4 mil) using a loop coater and dried at 60 ° C. The amounts of the materials used in each of the layers were calculated to give, after drying, the indicated coated coverages.

TABLE III

| MATERIAL | COVERAGE (mg/m²) Control-2 & First Imaging Layer of Test-2 | Control-3 & Second Imaging Layer of Test-2 |
|---|---|---|
| Silver Behenate | 2002 | 2002 |
| Polyvinylbutyral (Butvar-76, Monsanto) | 6134 | 3228 |
| Methyl Gallate | — | 215 |
| Phthalazinone | — | 108 |
| Leuco Thiolactone Dye (black:blue, 50:50) (formulae (II) and (III) herein) | 646 | — |
| 3,5-dihydroxybenzoic acid | 646 | — |
| bis[1,2,2,6,6-pentamethyl-4-piperidinyl]sebacate | 323 | — |

A thermographic recording film comprising an image-forming system which includes an imaging layer comprising bis[1,2,2,6,6-pentamethyl-4-piperidinyl]sebacate is disclosed and claimed in commonly-assigned, copending U.S. patent application Ser. No. 08/837,775, filed on even date herewith.

A washcoat and a topcoat were prepared and coated as aqueous solutions over the above-described image-forming systems of Test-2, Control-2 and Control-3, remote from the polyester base (4 mil) using a loop coater and dried at 60° C., the topcoat being adjacent the washcoat remote from the support, as further described below. The amounts of materials used in each of the layers were calculated to give, after drying, the indicated coated coverages.

| MATERIAL | COVERAGE (mg/m²) |
|---|---|
| WASHCOAT | |
| CYASTAT-SN (stearimidipropyl-dimethyl-β-hydroxyethylammonium nitrate) | 269 |
| ZONYL FSN | 32.3 |
| CYASTAT 609 (N,N'-Bis[2-hydroxyethyl]-N-[3'-dodecyloxy-2-hydroxypropyl]methyl-ammonium methosulfate) | 108 |
| Michelman Emulsion (ME 03230, silicone filtered, Silverson mixer) | 53.8 |
| 1,4-Butanediol diglycidyl ether | 215 |
| TOPCOAT | |
| High MW polyurethane latex (B. F. Goodrich) | 538 |
| CX-100 crosslinking compound (Zeneca) | 108 |

Each of the thermographic recording films prepared above was imaged by means of an Atlantek Tester direct thermal printer, headvoltage=25 V, $T_c$=10 milliseconds (ms). The visual densities of Control-2, Control-3 and Test-2 were measured at increasing contact time (ms) of the thermal printing head to the thermographic recording film, i.e., the longer the contact time, the higher the heat input to the medium, and are reported in TABLE IV.

TABLE IV

| VISUAL DENSITY at about 0.2 to about 2.0 Contact Time (ms) | | | | | | | | | | |
|---|---|---|---|---|---|---|---|---|---|---|
| FILM | 0.2 | 0.4 | 0.6 | 0.8 | 1.0 | 1.2 | 1.4 | 1.6 | 1.8 | 2.0 |
| Control-2 | 0.30 | 0.75 | 1.25 | 1.73 | 2.10 | 2.28 | 2.39 | 2.42 | 2.29 | 2.23 |
| Control-3 | 0.09 | 0.25 | 0.47 | 0.71 | 0.90 | 1.04 | 1.12 | 1.20 | 1.25 | 1.37 |
| Test-2 | 0.40 | 0.93 | 1.70 | 2.79 | 3.66 | 4.07 | 4.24 | 4.26 | 4.48 | 4.26 |

As will be appreciated by the data reported in TABLE IV, the thermographic recording film prepared according to the present invention, i.e., Test-2, is superior in terms of sensitivity to thermographic recording films comprising image-forming systems employing either thiolactone or silver reduction chemistry.

As will also be appreciated by the data reported in TABLE IV, specifically, the visual optical densities from about 0.8 to about 2.0 ms contact times, the thermographic recording film prepared according to the invention unexpectedly shows a synergistic versus an additive effect on the sensitivity, i.e., the visual optical densities reported for "Test-2" are greater at from about 0.8 to about 2.0 ms contact times than the visual optical densities reported for thermographic recording films comprising image-forming systems employing either thiolactone or silver reduction chemistry, but not both.

Although the invention has been described in detail with respect to various preferred embodiments thereof, those skilled in the art will recognize that the invention is not limited thereto but rather that variations and modifications can be made which are within the spirit of the invention and the scope of the appended claims.

What is claimed is:

1. A thermographic recording film comprising a support carrying an image-forming system comprising at least one layer and including a Lewis acid material, a di- or triarylmethane thiolactone dye precursor, an acidic organic material, a light insensitive organic silver salt, a reducing agent for the light insensitive organic silver salt and a binder.

2. A thermographic recording film as defined in claim 1 wherein said image-forming system further comprises a toning agent.

3. A thermographic recording film as defined in claim 2 wherein said toning agent is selected from the group consisting of phthalazinone, phthalazine and phthalimide.

4. A thermographic recording film as defined in claim 1 wherein said image-forming system further comprising is a fluorocarbon surfactant.

5. A thermographic recording film as defined in claim 1 wherein said image-forming system further comprises bis[1,2,2,6,6,-pentamethyl-4-piperidinyl]sebacate.

6. A thermographic recording film as defined in claim 1 wherein said Lewis acid material is a light insensitive organic silver salt.

7. A thermographic recording film as defined in claim 6 wherein said light insensitive organic silver salt is a silver salt of an aliphatic carboxylic acid that comprises an aliphatic carbon chain, said aliphatic carbon chain comprising at least twelve carbon atoms.

8. A thermographic recording film as defined in claim 7 wherein said light insensitive organic silver salt is silver behenate.

9. A thermographic recording film as defined in claim 1 wherein said acidic organic material is 3,5-dihydroxybenzoic acid.

10. A thermographic recording film as defined in claim 1 wherein said binder is polyvinylbutyral.

11. A thermographic recording film as defined in claim 1 wherein said light insensitive organic silver salt is a silver salt of an aliphatic carboxylic acid that comprises an aliphatic carbon chain, said aliphatic carbon chain comprising at least twelve carbon atoms.

12. A thermographic recording film as defined in claim 11 wherein said light insensitive organic silver salt is silver behenate.

13. A thermographic recording film as defined in claim 1 wherein said reducing agent is methyl gallate.

14. A thermographic recording film as defined in claim 1 further including a protective layer.

15. A thermographic recording film as defined in claim 1 wherein said image-forming system comprises a first layer including a Lewis acid material, a di-or triarylmethane thiolactone dye precursor, an acidic organic material and a binder, and a second layer including a light insensitive organic silver salt, a reducing agent and a binder.

16. A thermographic recording film as defined in claim 15 further including a protective layer.

17. A thermographic recording film as defined in claim 16 wherein said first layer further includes bis[1,2,2,6,6,-pentamethyl-4-piperidinyl]sebacate and said second layer further includes a toning agent selected from the group consisting of phthalazinone, phthalazine and phthalimide.

18. A thermographic recording film comprising a support carrying in sequence:

(a) an image-forming system comprising a first layer including a Lewis acid material, a di- or triarylmethane thiolactone dye precursor, an acidic organic material and a binder and a second layer including a light insensitive organic silver salt, a reducing agent for the light insensitive organic silver salt and a binder, wherein said second layer is positioned above said second layer; and (b) a protective layer positioned above said second layer of said image-forming system.

19. A thermographic recording film as defined in claim 18 wherein said Lewis acid material and said light-insensitive organic silver salt are silver behenate, said acidic organic material is 3,5-dihydroxybenzoic acid, said binder is polyvinylbutyral, said reducing agent is methyl gallate, said first layer further includes bis[1,2,2,6,6,-pentamethyl-4-piperidinyl]sebacate and said second layer further includes a toning agent selected from the group consisting of phthalazinone, phthalazine and phthalimide.

20. A thermographic recording film as defined in claim 19 further including a fluorocarbon surfactant.

* * * * *